US006568569B1

(12) United States Patent
Betz

(10) Patent No.: US 6,568,569 B1
(45) Date of Patent: May 27, 2003

(54) LIQUID DISPENSER FOR A SINK

(76) Inventor: Jonathan P. Betz, 18 Normandy Cir., Glenmoore, PA (US) 19343

( * ) Notice: Subject to any disclaimer, the term of this patent is extended or adjusted under 35 U.S.C. 154(b) by 93 days.

(21) Appl. No.: 09/645,969

(22) Filed: Aug. 24, 2000

(51) Int. Cl.[7] ..... B67D 5/00

(52) U.S. Cl. ..... 222/321.1; 222/321.7; 222/372; 141/382; 141/384

(58) Field of Search ..... 222/321.1, 321.7, 222/372; 141/382–384

(56) References Cited

U.S. PATENT DOCUMENTS 3,078,471 A * 2/1963 Knibb ..... 222/321.1
4,993,573 A * 2/1991 Freidel et al. ..... 215/309
5,947,339 A * 9/1999 Boshears et al. ..... 222/183
5,988,451 A * 11/1999 Hanna ..... 222/321.1
6,119,901 A * 9/2000 Hanna ..... 222/321.1
6,206,241 B1 * 3/2001 Terrell et al. ..... 222/63

* cited by examiner

*Primary Examiner*—J. Casimer Jacyna
(74) *Attorney, Agent, or Firm*—Drinker Biddle & Leath LLP

(57) ABSTRACT

A liquid dispenser for a sink is disclosed which includes a pump assembly with a reciprocatable pump head and a dispensing nozzle. A mounting fixture is adapted to be attached to the sink and configured to support the pump assembly. A fluid line is attached to the pump assembly and adapted to channel a fluid from a dispenser bottle to the dispensing nozzle. The fluid line has a length that permits the dispenser bottle to be located on the base of a cabinet supporting the sink. A check valve is positioned within the fluid line and adapted to inhibit fluid flow along the fluid line in a direction toward the dispenser bottle when the fluid line is attached to a dispenser bottle. A kit is also disclosed for modifying a standard liquid dispenser to permit use of conventional soap or lotion bottles.

16 Claims, 3 Drawing Sheets

LIQUID DISPENSER FOR A SINK

FIELD OF THE INVENTION

The present invention relates to a liquid dispenser for a sink and, more particularly, to a liquid dispenser which permits use of conventional containers of soap or hand lotion.

BACKGROUND OF THE INVENTION

Many current sinks in households and commercial establishments include a removable plug adjacent to the sink bowl which is designed to accept a spray head or soap dispenser assembly. Dispensing assemblies are readily available for mounting to the sink. As shown in FIG. 1, these conventional dispensers include a pump assembly 2 that is attached to the sink S. The pump assembly 2 includes a dispenser nozzle 4 and an actuation mechanism 5, such as a translatable pump head. The pump assembly 2 also includes a pick-up tube 6 which is attached to the actuation mechanism 5 and extends underneath the sink into a dispenser bottle 7. The dispenser bottle 7 is attached to the lower end of a mounting fixture 8 and hangs directly from the sink S.

There are basically two ways to fill conventional dispenser bottles. One type of dispensing assembly is designed to permit the pump assembly to be removed from the mounting fixture. The soap or lotion is poured directly into dispenser bottle through an opening in the mounting fixture. The pump head is then replaced and actuated to cause soap to be dispensed from the pumping assembly.

In the second type of dispensing assembly, the pump assembly is fixedly attached to the mounting fixture and the dispenser bottle is threaded to the mounting fixture. As such, in order to fill the bottle, the bottle must first be unscrewed from the fixture.

One of the problems with the second type of dispensing assembly is that refilling the bottle requires reaching under the sink to locate the dispenser bottle and unscrewing it from the mounting assembly. Since soap dispensers are typically at the rear of the sink, the dispenser bottles are usually located in the very far recesses of the cabinet underneath the sink and can be difficult to remove and replace.

Also, with both types of dispensing assemblies, it is not possible to view the dispenser bottle. As such, the user does not know whether or not the bottle is empty until soap can no longer be dispensed from the dispenser assembly. This can be a particular problem in commercial establishments, such as restaurants and public restrooms, where it is not convenient for the maintenance personnel to constantly access the facility to determine whether a bottle needs to be filled.

A need therefore exists for an improved liquid dispenser for mounting to a home or commercial sink which provides easy accessibility to the dispenser bottle for viewing and refilling.

SUMMARY OF THE INVENTION

The present invention is directed toward a liquid dispenser for a sink which includes a pump assembly with a reciprocatable pump head and a dispensing nozzle. A mounting fixture is adapted to be attached to a sink and configured to support the pump assembly so that the pump head reciprocates with respect to the mounting fixture. A fluid line is attached to the pump assembly and adapted to channel a fluid from a dispenser bottle to the dispensing nozzle. The fluid line has a length that permits the dispenser bottle to be located on the base of a cabinet under the sink. A check valve is positioned within the fluid line and adapted to inhibit fluid flow along the fluid line in a direction toward the dispenser bottle when the fluid line is attached to a dispenser bottle.

The present invention can also be used to modify an existing liquid dispenser on a sink to use a conventional soap container.

In one embodiment of the invention, a plurality of pump assemblies are mounted to a single mounting fixture for permitting the dispensing of multiple liquids (e.g., soap and lotion).

The foregoing and other features and advantages of the present invention will become more apparent in light of the following detailed description of the preferred embodiments thereof, as illustrated in the accompanying figures.

DETAILED DESCRIPTION OF THE PREFERRED EMBODIMENTS

While the invention will be described in connection with one or more preferred embodiments, it will be understood that it is not intended to limit the invention to those embodiments. On the contrary, it is intended that the invention cover all alternatives, modifications and equivalents as may be included within its spirit and scope as defined by the appended claims.

Figure 2:
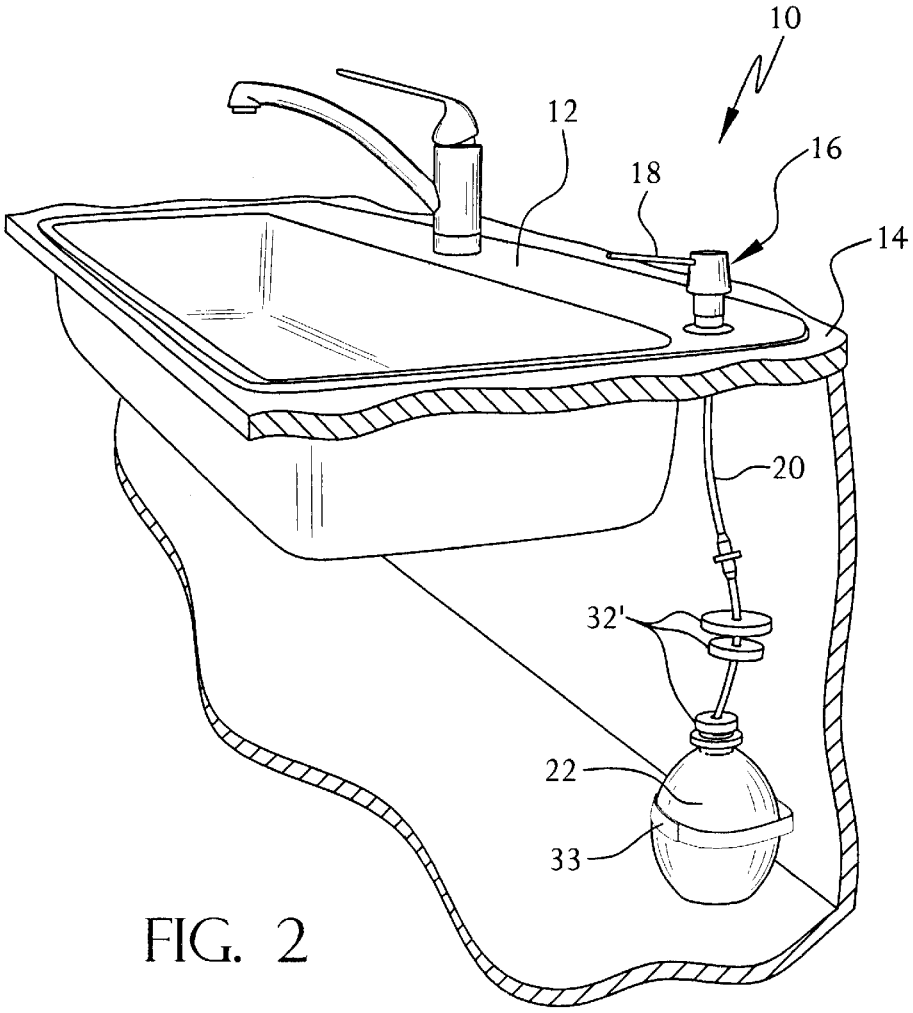
FIG. 2 is a partial perspective view of a liquid dispenser assembly for a sink according to the present invention.

Referring now to the drawings, wherein like reference numerals illustrate corresponding or similar elements throughout the several views, FIG. 2 is a perspective view showing a dispensing assembly 10 of the present invention located in combination with a conventional sink 12. The sink 12 is shown mounted within a cabinet 14. The dispenser assembly 10 can be mounted to the cabinet 14 or, more preferably, the dispenser assembly 10 is mounted directly to the sink 12. The mounting can be accomplished by attaching the dispenser assembly 10 to a hole in the sink 12 that, in many sinks, is designed to hold a spray head. The hole is usually filled with a removable plug (not shown).

The dispenser assembly 10 includes a pump assembly 16 with a dispenser nozzle 18. A fluid line 20 is attached to the pump assembly 16 and extends into the cabinet 14. A lower end of the fluid line 20 is located within a conventional soap or lotion bottle 22 (hereinafter referred to as the dispenser bottle) as will be discussed in more detail below.

Figure 3B:
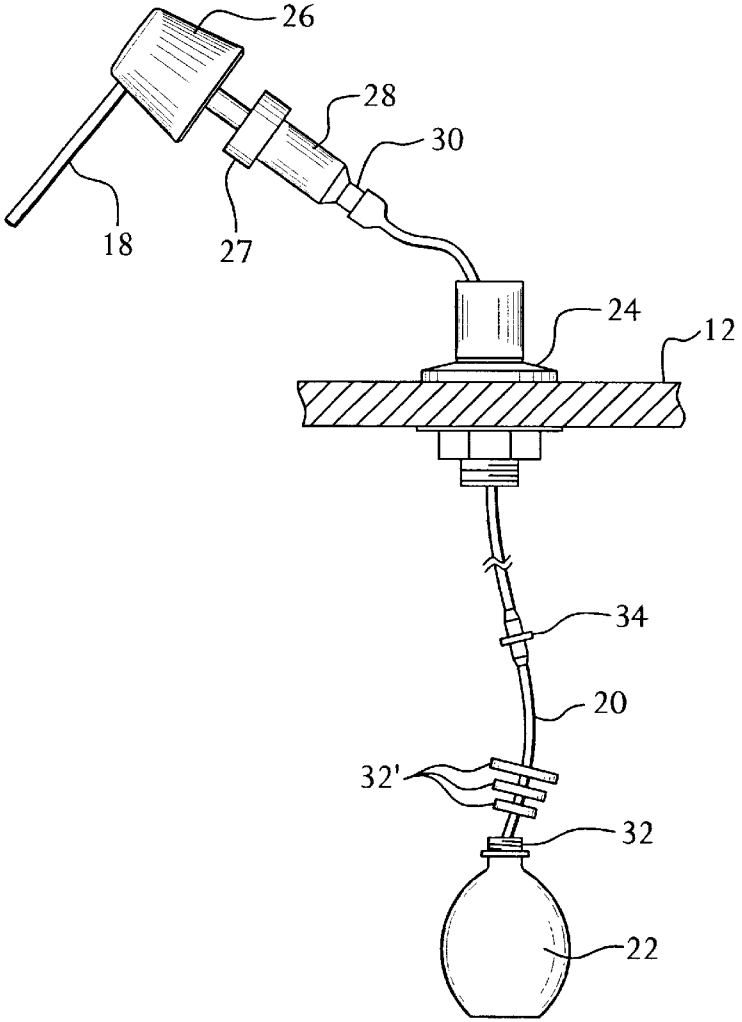
FIG. 3B is partial cross-sectional view of another embodiment of the pump assembly according to the present invention illustrating the pump assembly removed from the base fixture.
Figure 3A:
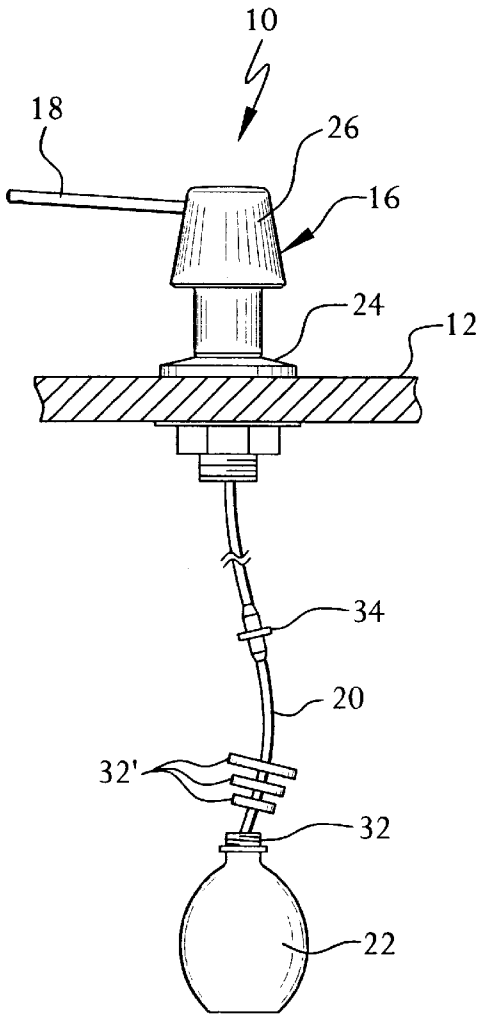
FIG. 3A is a partial cross-sectional side view of one embodiment of the pump assembly according to the present invention.

Referring to FIG. 3A, a cross-sectional view of the dispensing assembly 10 according to the present invention is shown mounted to the cabinet 14. More particularly, the dispensing assembly 10 includes a mounting fixture 24 which is attached to the cabinet 14 and/or the sink 12. A hole (not shown) extends through the mounting fixture 24 and permits the fluid line 20 to pass from the pump assembly 16 to the dispenser bottle 22. For the sake of simplicity, the dispenser assembly 10 will be described as being attached to the sink. However, it should be understood that the term sink with respect to the mounting of the dispenser assembly 10 also contemplates directly mounting of the dispenser assembly 10 to the cabinet 14, adjacent to the sink 12.

One feature of the invention is the ability to locate the dispenser bottle 22 in a location where it is easily accessible, such as on the base of the cabinet 14 as shown. Accordingly, the fluid line 20 has a length that permits locating the dispenser bottle 22 in such a manner. Preferably, the fluid line 20 has a length longer than 2 feet and, more preferably has a length that is at least approximately 3 feet long. The fluid line 20 preferably has an outer diameter of approximately ⅜th inch and an inner diameter of approximately ¼ inch. The fluid line 20 is preferably made from a material designed to withstand conventional soap detergents, such as vinyl.

As shown in FIGS. 3A and 3B, the pump assembly 16 includes a pump head 26 which is designed to reciprocate with respect to a pump base 27. Pump assemblies are well known in the art and, therefore, the specific details ofthe pump assembly are not necessary for a complete understanding of the invention.

The pump assembly 16 according to the present invention can be designed as either fixed mounted to the cabinet (as shown in FIG. 3A), or removable from the cabinet for permitting liquid to be dispensed at a particular location (as shown in FIG. 3B). The fluid line 20 is preferably long enough to permit the pump assembly 16 to be extended a substantial distance from the mounting fixture 24. In the case of the fixed-mounted pump assembly, the pump head 26 is preferably attached to the mounting fixture 24 so as to be essentially non-removable when in use.

For the removable pump assembly, the pump head 26 rests on, and is removable from, the mounting fixture 24. More particularly, the mounting fixture 24 includes a seat on which the pump assembly rests. In this embodiment, the fluid line 20 is preferably long enough to permit the pump head 26 to be removed from the mounting fixture 24 and positioned where needed without disrupting the dispenser bottle 22. A stop (not shown) may be attached to the fluid line 20 and adapted to limit the extension of the fluid line 20 out of the mounting fixture 24. The removable pump assembly 16 also preferably includes a hand grip 28 on the pump base 27 for the user to hold when the user removes the pump assembly to dispense liquid at a particular location.

The pump assembly 16 also includes a tube 30 that is fluidly connected to the pump base 27 for transferring fluid to the dispenser nozzle 18. The tube 30 extends through an opening in the mounting fixture 24. The tube 30 may be removable from the pump assembly 16 or may be a fixed extension of the assembly.

The fluid line 20 attaches to the tube 30, thereby permitting fluid to flow from the dispenser bottle 22 to the nozzle 18. The opposite end of the fluid line 20 is located within the dispenser bottle 22. In the illustrated embodiment, the line 20 is attached to the bottle 22 through a cap 32, such that the end of the fluid line 20 is located within the dispenser bottle 22. The cap includes a hole through which the fluid line 20 passes, and preferably one or more vent holes for venting air.

Since it is contemplated that the dispenser bottle 22 of the present invention will be a conventional liquid soap or lotion bottle, a plurality of caps 32' are preferably mounted to the line 20, each having a different diameter, thereby permitting the user to select the appropriate bottle cap 32 to fit the bottle 22. To prevent loss of the caps 32', the unused caps may be located on the fluid line 20, as shown.

A check valve 34 is preferably mounted along the fluid line 20 to prevent fluid from flowing from the dispenser nozzle 18 back into the bottle 22. The check valve 34 includes flexible flaps or ribs which cover the fluid flow path through the fluid line. The flaps are designed to deflect in one direction upon application of pressure (either air or liquid), thus permitting fluid flow through the fluid line. In the illustrated embodiment, the valve 34 is located midway long the fluid line 20. However, it is contemplated that the check valve 34 may be located anywhere on the fluid line 20. The check valve 34 can be made from any suitable material, such as polycarbonate or nylon material. Fluid check valves 34 are well known in the art and, therefore, no further discussion is needed.

Figure 1:
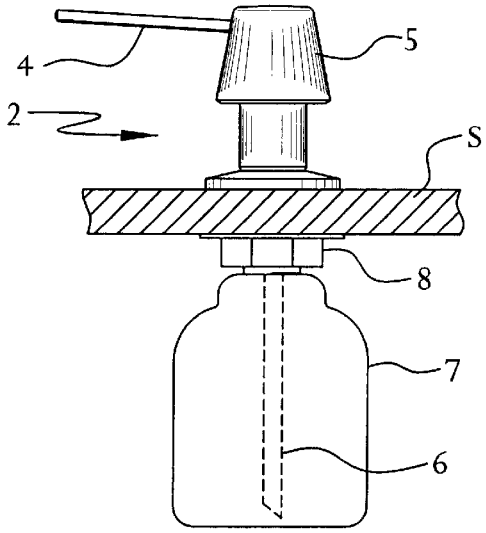
FIG. 1 (Prior Art)
FIG. 1 is a partial cross-sectional side view of a conventional liquid dispenser assembly.

As discussed above, the dispenser bottle 22 sits on the base of the cabinet 14. The bottle 22 may be removably attached to the cabinet 14, such as with a strap 33 mounted to the cabinet 14 (shown in FIG. 1). Velcro® or a similar type hook and loop fastener can be used to removably secure the strap 33 to the bottle 22. (Velcro® is a registered trademark of Velcro USA Inc., Manchester, Ohio.)

Figure 5:
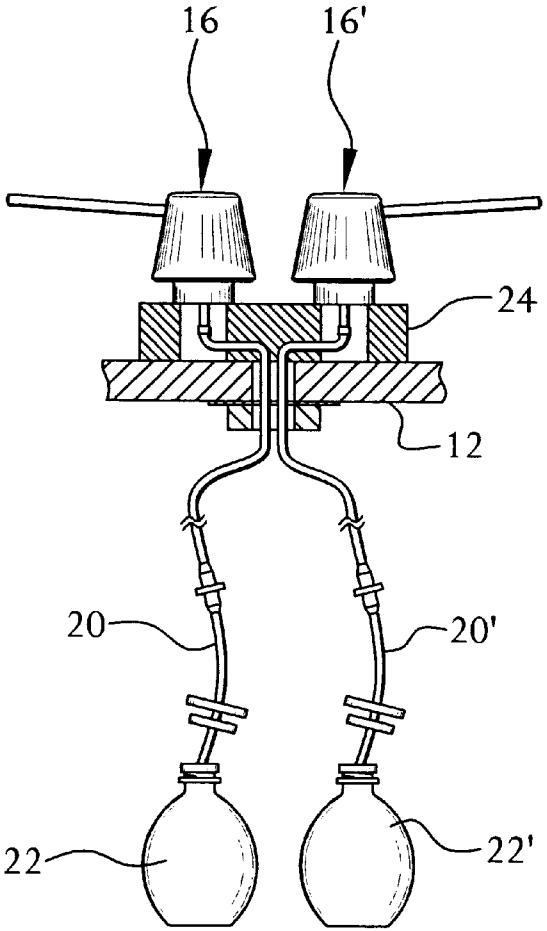
FIG. 5 is a partial cross-sectional view of the liquid dispenser in FIG. 4 illustrating the attachment of the two pump assemblies to a single mounting fixture.
Figure 4:
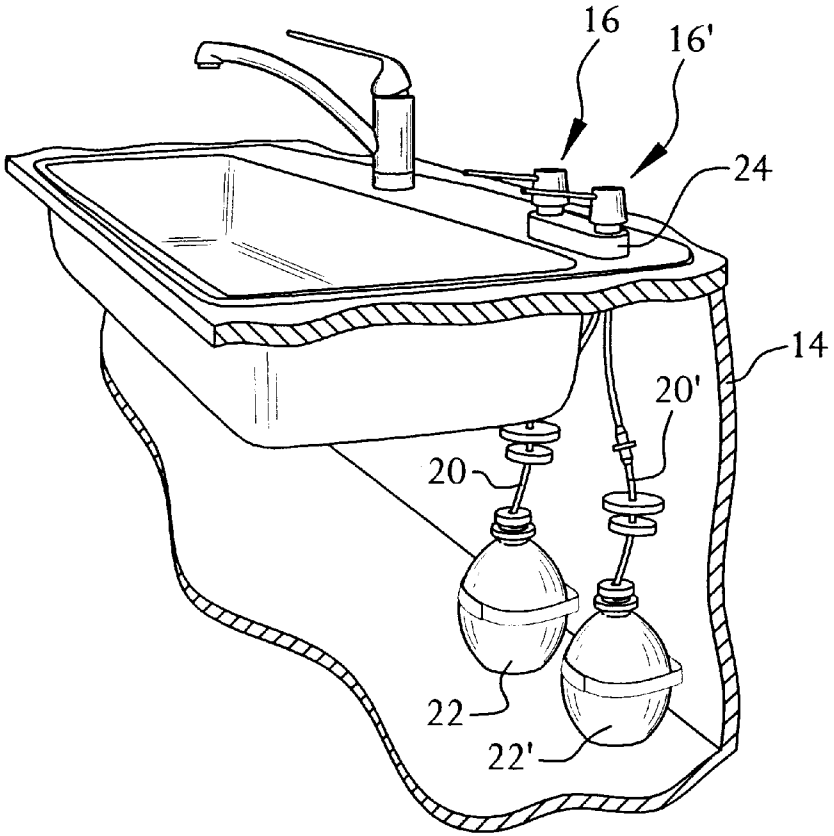
FIG. 4 is a perspective view of another embodiment of the present invention illustrating two pump assemblies attached to a sink.

Referring now to FIG. 4, an alternate embodiment of the present invention is shown. In this embodiment, there are two pump assemblies 16, 16' mounted adjacent to the sink 12. Each pump assembly 16, 16' is substantially the same as described above and includes an associated dispenser bottle 22, 22'. One of the dispenser bottles 22 may contain hand soap, while the other dispenser bottle 22' may container a different liquid, such as a dishwashing detergent or hand lotion. The pump assemblies 16 can be separately attached to the sink, or may be part of a joint dispenser unit as shown, i.e., one mounting fixture 24 which holds both pump assemblies (see, FIG. 5).

It is also contemplated that the present invention may be sold as a replacement or modification kit for previously installed dispensers. In this embodiment, the kit would include the fluid line 20 with the check valve 34. The fluid line 20 would, again, have a length long enough to position the dispenser bottle 22 in a suitable location within the cabinet 14 where it is easily accessible, such as on the base. The plurality of caps 32', as well as the strap, would also be provided in the kit. The installation of the kit would involve removing the old dispenser bottle, attaching the fluid line 20 to the existing pick-up tube or directly to the pump assembly and attaching the other end ofthe fluid line to a conventional bottle of soap or lotion.

The present invention provides a novel device for replacing or modifying a soap and/or lotion dispenser to permit usage of conventional soap or lotion containers. The invention also permits the dispenser bottle to be located in a place that is easily accessible.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A liquid dispenser for a sink comprising:

a pump assembly including a reciprocatable pump head with a dispensing nozzle;

a mounting fixture adapted to be attached to a sink and configured to support the pump assembly so that the pump head reciprocates with respect to the mounting fixture;

a fluid line attached to the pump assembly and adapted to channel a fluid from a dispenser bottle to the dispensing nozzle, the fluid line having a length for permitting the dispenser bottle to be located on the base of a cabinet supporting the sink; and a plurality of bottle engaging elements each adapted to connect the fluid line to a dispenser bottle, each of the elements having differing diameters to provide for connection of the fluid line to differing dispenser bottles.

2. The liquid dispenser of claim 1, further comprising a check valve positioned within the fluid line and adapted to inhibit fluid flow along the fluid line in a direction toward the dispenser bottle when the fluid line is attached to a dispenser bottle.

3. The liquid dispenser of claim 1, wherein the pump assembly is removable from the mounting fixture.

4. The liquid dispenser of claim 3, wherein the pump assembly further includes a hand grip.

5. The liquid dispenser of claim 1, wherein the mounting fixture is attached to the sink, and wherein the fluid line is attached to a dispensing bottle positioned on the base of the cabinet.

6. The liquid dispenser of claim 5, wherein the dispenser bottle is removably attached to the cabinet.

7. The liquid dispenser of claim 6, wherein the removable attachment is provided by a strap mounted to the cabinet, the strap having a hook and loop fastener for securing the bottle to the cabinet.

8. The liquid dispenser according to claim 1 wherein each of the bottle engaging elements is a separate cap, each cap adapted for receipt of the fluid line.

9. A liquid dispenser for a sink comprising:

a pump assembly including a reciprocatable pump head with a dispensing nozzle;

a mounting fixture adapted to be attached to a sink and configured to support the pump assembly so that the pump head reciprocates with respect to the mounting fixture;

a fluid line attached to the pump assembly and adapted to channel a fluid from a dispenser bottle to the dispensing nozzle, the fluid line having a length for permitting the dispenser bottle to be located on the base of a cabinet supporting the sink; and a plurality of caps removably attached to the fluid line and adapted to connect the fluid line to the dispenser bottle.

10. A liquid dispenser for a sink comprising:

at least one pump assembly having a pump head with a dispensing nozzle and a base, the pump head reciprocatable with respect to the pump base;

a mounting fixture adapted to be attached to a sink and configured to support the at least one pump assembly;

a fluid line attached to the pump assembly and adapted to channel a fluid from a dispenser bottle to the dispensing nozzle, the fluid line having a length for permitting the dispenser bottle to be located on the base of a cabinet supporting the sink, the fluid line including a check valve positioned within the fluid line and adapted to inhibit fluid flow along the fluid line in a direction toward the dispenser bottle when the fluid line is attached to a dispenser bottle; and a plurality of caps removably attached to the fluid line, each cap having a different diameter, the caps adapted to connect the fluid line to a dispenser bottle.

11. The liquid dispenser of claim 10, wherein the pump assembly is removable from the mounting fixture.

12. The liquid dispenser of claim 9, wherein there are a plurality of pump assemblies mounted to the mounting fixture, each pump assembly connected to an independent fluid line.

13. A kit for modifying a liquid dispenser mounted to a sink, the liquid dispenser including a pump assembly with a pump head, a dispensing nozzle attached to the pump head, and a pump base with a fluid port, the pump head adapted to reciprocate with respect to the pump base for causing fluid to flow from the fluid port in the pump base to the pump nozzle, the kit comprising:

a flexible fluid line adapted to be attached to the fluid port on the pump base, the flexible fluid line adapted to channel a fluid from a dispenser bottle to the pump base, the fluid line having a length sufficient to permit the dispenser bottle to be located on the base of the cabinet, the fluid line including a check valve positioned within the fluid line and adapted to inhibit fluid flow along the fluid line in a direction of the dispenser bottle when the fluid line is attached to a dispenser bottle; and a plurality of caps removably engaged with the fluid line, each cap having a different diameter, the caps adapted to connect the fluid line to a dispenser bottle.

14. The kit according to claim 13, further comprising means for removably attaching a dispenser bottle to a cabinet.

15. The kit according to claim 14, wherein the means for removably attaching includes a strap adapted to be attached to the cabinet, the strap having a fastener for securing the bottle to the cabinet.

16. The kit according to claim 13, wherein the fluid port is a pick-up tube extending out of the pump base, and wherein the fluid line attaches to the pick-up tube.

* * * * *